US005358025A

United States Patent [19]

Wood

[11] Patent Number: 5,358,025

[45] Date of Patent: Oct. 25, 1994

[54] FABRIC GARAGE ENCLOSURE

[76] Inventor: Cliff Wood, 2728 Hop Ranch Rd., Union City, Calif. 94587

[21] Appl. No.: 23,892

[22] Filed: Feb. 26, 1993

[51] Int. Cl.[5] ..... E06B 9/00

[52] U.S. Cl. ..... 160/368.1; 160/327

[58] Field of Search ..... 160/368.1, 354, 327, 160/330, 87, 123

[56] References Cited

U.S. PATENT DOCUMENTS

| | | | |
|---|---|---|---|
| 545,655 | 9/1895 | Jones | 160/85 X |
| 673,703 | 5/1901 | Davis et al. | 160/368.1 X |
| 2,082,406 | 6/1937 | Lloyd et al. | 160/85 X |
| 2,281,022 | 4/1942 | Cavanaugh | 160/85 |
| 3,276,512 | 10/1966 | Gallagher | 160/368.1 |
| 3,455,366 | 7/1969 | Bogumil . | |
| 4,231,412 | 11/1980 | Nowak . | |
| 4,378,043 | 2/1983 | Sorenson . | |
| 4,673,019 | 6/1987 | Silverthorne et al. . | |
| 4,846,241 | 7/1989 | Chomka et al. . | |

*Primary Examiner*—Blair M. Johnson

[57] ABSTRACT

An enclosure device is disclosed that can be utilized to cover a garage door opening for privacy and security. The device includes a fabric portion and a plurality of fasteners. The fabric portion provides privacy while allowing for plenty of light and ventilation. The fabric portion also acts as a psychological barrier for possible intruders who would be unable to determine whether the garage is occupied. The plurality of fasteners allows the user to attach the enclosure device to a garage door opening. The fasteners also provide for increased security.

5 Claims, 2 Drawing Sheets

FABRIC GARAGE ENCLOSURE

BACKGROUND OF THE INVENTION

1. Field of the Invention

The invention relates generally to an enclosure that secures the opening of a garage and more particularly to those of a non-rigid nature.

2. Background of the Invention

Many homeowners use their garage for much more than parking cars. A garage can be a convenient space for a laundry area, a hobbyist's workshop, a home office or a home gym.

Garage enclosures are known in the art. For example, U.S. Pat. No. 4,846,241 Screen Closure For Garage Door Openings teaches a roll-up enclosure comprising standard screen material and a metal cranking device for raising and lowering.

Although this device would work adequately for its intended purpose, it has three major problems. Firstly this type of garage enclosure is difficult to install and equally difficult to deinstall. Secondly the standard screen material provides no privacy in that the material does not limit visibility from the outside. Thirdly this device provides no security.

A second example, U.S. Pat. No. 3,455,366 Quick Demountable Screen For Enclosing Garage Doorways And The Like teaches an enclosure comprising standard screen material held in place with metal clips.

Although this device would work adequately for its intended purpose, it has three major problems. Firstly this type of garage enclosure is difficult to install and equally difficult to deinstall. Secondly the standard screen material provides no privacy in that the material does not limit visibility from the outside. And thirdly, this enclosure is not easily stored.

A third example, U.S. Pat. No. 4,378,043 Pivoting Screen Panel For Sectional Garage Door teaches a metal enclosure that attaches to the existing garage door.

Although this device would work adequately for its intended purpose, it has four major problems. Firstly this type of garage enclosure requires a high degree of skill to install and deinstall. Secondly the metal material provides no privacy in that the material does not limit visibility from the outside. Thirdly, this enclosure is not easily stored. And lastly, this device provides no security.

A fourth example, U.S. Pat. No. 4,231,412 Folding Garage Screen Door teaches an enclosure that comprises a folding screen.

Although this device would work adequately for its intended purpose, it has five major problems. Firstly this type of garage enclosure is bulky in composition and is constructed of a heavy material. Secondly the device is difficult to install and deinstall. Thirdly the material, although heavy, provides no privacy in that it does not limit visibility from the outside. In addition this enclosure is not easily stored. And lastly, this device provides no security.

A fifth example, U.S. Pat. No. 4,673,019 Garage Door Screen Enclosure teaches an enclosure that requires a metal rod attached to a pulley to open and close.

Although this device would work adequately for its intended purpose, it has four major problems. Firstly this type of garage enclosure is difficult to install and deinstall. Secondly the material provides no privacy in that it does not limit visibility from the outside. Thirdly, this enclosure is not easily stored. And lastly, this device provides no security.

Another example, U.S. Pat. No. 673,703 Door Guard teaches an enclosure that comprises a webbing of leather straps.

Although this device would work adequately for its intended purpose, it has two major problems. Firstly this type of enclosure provides no privacy in that it does not limit visibility from the outside. In addition this device provides no security.

A final example, U.S. Pat. No. 3,276,512 Cover For The Interior Of An Automobile teaches an enclosure that comprises an opaque material.

Although this device would work adequately for its intended purpose and would provide a measure of privacy, it has two major problems. Firstly, as the material is opaque it limits visibility from the outside, but it also limits the ability of the user on the inside to see out. In addition this device provides no security.

Therefore, what is needed is a garage enclosure comprising a lightweight material which limits visibility from the outside without restricting visibility from inside the garage. In addition, this device should require no expertise to install, should fit any size garage door opening and should store easily. Finally, this device should provide security by locking from the inside.

DETAILED DESCRIPTION OF THE DRAWINGS

The present invention relates to an improvement in fabric enclosures for garage door openings. The following description is presented to enable one of ordinary skill in the art to make and use the invention and is provided in the context of a particular application and its requirements. Various modifications to the preferred embodiment will be readily apparent to those skilled in the art, and the generic principles defined herein may be applied to other embodiments. Thus, the present invention is not intended to be limited to the embodiment shown, but is to be accorded the widest scope consistent with the principles and features described herein.

Figure 1:
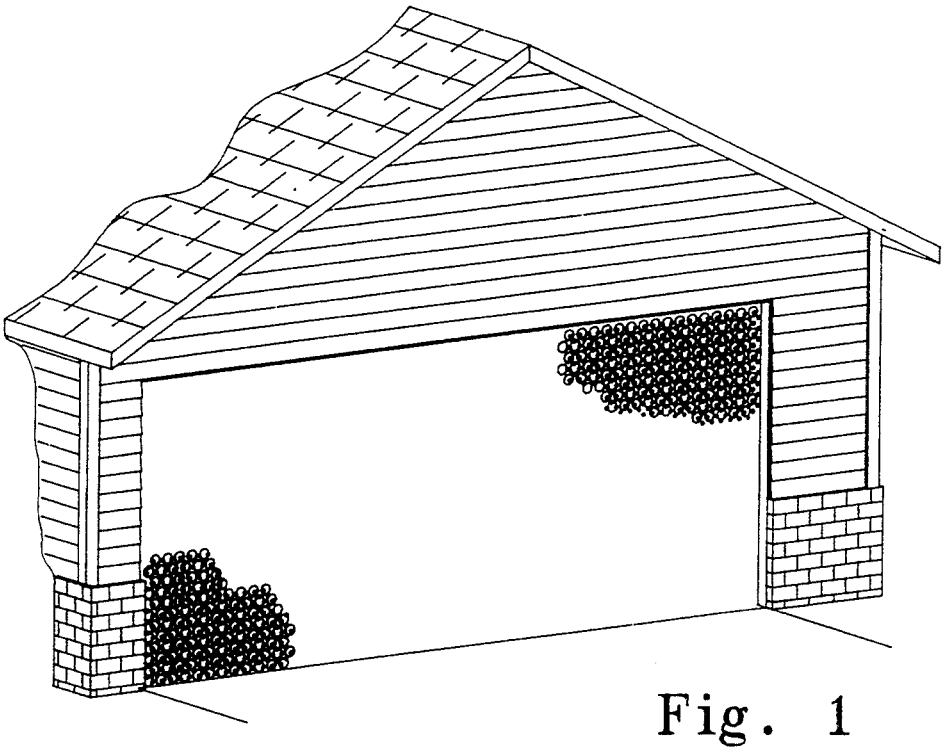
FIG. 1 is a perspective view of the garage enclosure of the present invention from the outside.

To more fully understand the present invention refer now to FIG. 1. In accordance with the present invention there is shown a perspective view of the enclosure device installed on a garage door opening as seen from the outside. The enclosure device comprises a fabric portion 3.

Figure 2:
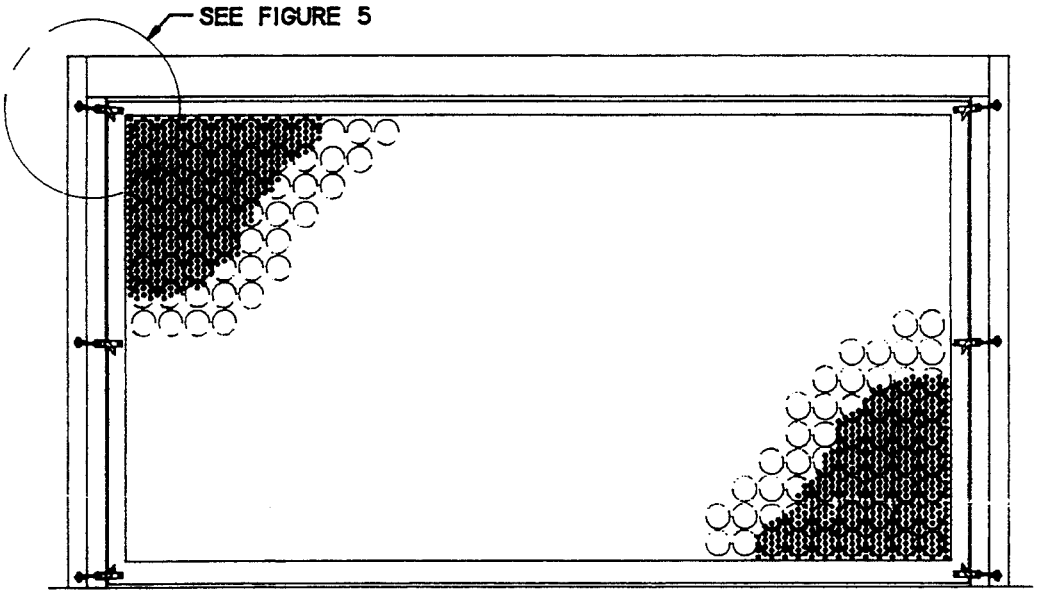
FIG. 2 is a perspective view of the garage enclosure of the present invention from the inside.

FIG. 2 shows a perspective view of the enclosure device of the present invention installed on a garage door opening as seen from the inside. The enclosure device comprises a fabric portion 3. The device also comprises a plurality of attachment means for securing the enclosure device to the inside of a garage door opening.

Figure 3:
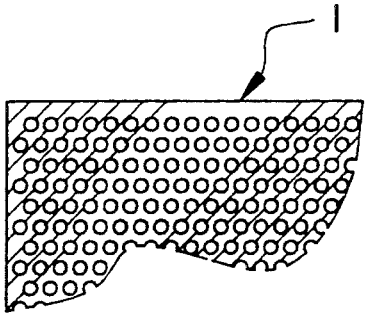
FIG. 3 is a diagrammatic view of the fabric design of the present invention from the inside.

FIG. 3 is a diagrammatic view of the inside fabric design 1 of the fabric portion 3. The inside fabric design 1 comprises a material that is light in color. The inside fabric design 1 comprises a material with a plurality of small holes.

Figure 4:
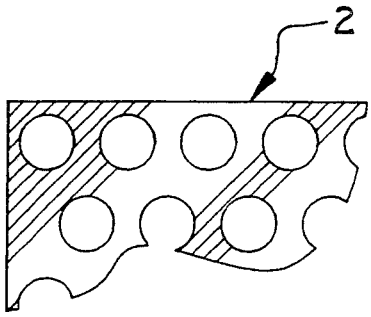
FIG. 4 is a diagrammatic view of the fabric design of the present invention from the outside.

FIG. 4 is a diagrammatic view of the outside fabric design 2 of the fabric portion 3. The outside fabric design 2 comprises a material that is darker in color than that of the inside fabric design 1. The outside fabric design 2 comprises a material with a plurality of holes that are larger than those of the inside fabric design 1. This configuration of color and hole size limits visibility from the outside without compromising the user's ability to see out from the inside. Although a specific embodiment of fabric design is shown in FIGS. 3 and 4, there are many others that may be within the spirit and scope of the present invention.

Figure 5:
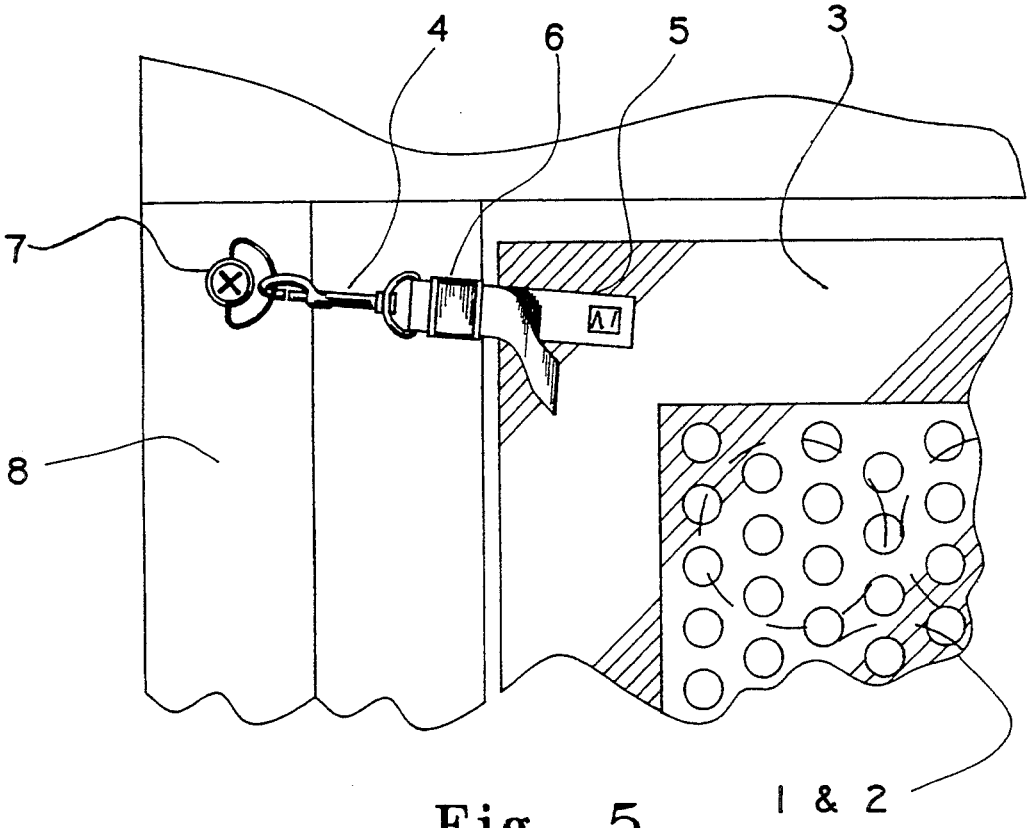
FIG. 5 is a diagrammatic view of the installation system of the present invention.

Referring now to FIG. 5, the attachment means comprises a cloth fastener 5, a buckle fastener 6, a snap-hook fastener 4 and a loop fastener 7. The cloth fastener 5 is the means by which the attachment means is secured to fabric portion 3. The snap-hook fastener 4 is the means by which the attachment means is secured to the loop fastener 7. The loop fastener 7 is mounted, using its built-in screw, to the header structure 8 of the garage door opening. The buckle fastener 6 is the means by which the cloth fastener 5 attaches to the snap-hook fastener 4. The positioning of a plurality of attachment means along the vertical edges of the fabric portion 3 allows for security for the user. Although a specific embodiment of attachment means is shown in FIG. 5, there are many others that may be within the spirit and scope of the present invention.

Installation is accomplished by securing the enclosure device to the inside of the garage door opening with a plurality of attachment means. A user would simply mount a plurality of loop fasteners 7 along the header structure 8 of the garage door opening and attach a snap-hook fastener 4 to each loop fastener 7. For a taut fit, the cloth fastener 5 and buckle fastener 6 can be adjusted in concert. To deinstall, a user would detach the plurality of snap-hook fasteners 4 and roll the enclosure device for easy storage.

The enclosure device provides the privacy of a closed garage door while allowing for plenty of light and ventilation. The enclosure device acts as a psychological barrier for possible intruders who would be unable to determine whether the garage is occupied, as well as an actual barrier due to the security provided by the attachment means.

Although the present invention has been described in accordance with the specific embodiments shown in FIGS. 1 through 5, one of ordinary skill in the art recognizes that there could be variations to the embodiment and those variations would be within the spirit and scope of the present invention. For example, the attachment means could comprise a plurality of padlock fasteners or the like and that use would be within the spirit and scope of the present invention. Similarly the fabric design shown in the figures could comprise differently shaped holes and that change is within the spirit and scope of the present invention. Also the loop fasteners shown in the figures could be mounted to the header of the garage door opening with nails or the like and that change is within the spirit and scope of the present invention.

These and other modifications may be made by those of ordinary skill in the art without departing from the spirit and scope of the present invention, the scope of which is defined solely by the appended claims.

What is claimed is:

1. An apparatus for enclosure of the main opening of a garage comprising:

a substantially rectangular non-rigid fabric portion, comprising inner and outer superimposed fabric elements joined together at at least a portion of peripheries thereof, said inner element is of a light color with a plurality of small holes, the outer element being of a color which is dark relative to the color of said inner element and having a plurality of holes large relative to the holes in said inner element, said fabric portion being adapted to fit over the frame structure of the main opening of the garage door;

a plurality of adjustable attachment means, located along the vertical and horizontal sides of the fabric portion, to adjustably secure said fabric portion to the frame structure of the main opening of a garage.

2. The apparatus of claim 1 in which the plurality of small holes are approximately round in shape.

3. The apparatus of claim 2 in which the plurality of small, round holes are approximately 0.25 inches in diameter.

4. The apparatus of claim 1 in which the plurality of large holes are approximately round in shape.

5. The apparatus of claim 4 in which the plurality of large, round holes are approximately 0.50 inches in diameter.

* * * * *